US005494092A

United States Patent [19]

Georgopoulos

[11] Patent Number: 5,494,092

[45] Date of Patent: Feb. 27, 1996

[54] SAFETY TASSEL FOR VENETIAN BLINDS

[75] Inventor: George Georgopoulos, Pine Brook, N.J.

[73] Assignee: Frid Enterprises Inc., Pine Brook, N.J.

[21] Appl. No.: 337,999

[22] Filed: Nov. 10, 1994

[51] Int. Cl.[6] ..... E06B 9/38

[52] U.S. Cl. ..... 160/178.1; 24/115 F

[58] Field of Search ..... 160/178.1 R, 178.1 V, 160/173 R, 173 V, 178.2 R, 168.1 R, 168.1 V, 320; 24/115 F, 115 H, 115 G, 115 M, 136 R, 114.5, 136 R; 16/114 B, 122, 217, 218, DIG. 12; 428/28

[56] References Cited

U.S. PATENT DOCUMENTS

| | | | |
|---|---|---|---|
| 515,155 | 2/1894 | Nelson | 24/136 L |
| 3,727,665 | 4/1973 | Debs | 160/168.1 R X |
| 4,782,560 | 11/1988 | Keller | 24/136 L |
| 4,909,298 | 3/1990 | Langhart et al. | 160/320 X |
| 4,940,070 | 7/1990 | Warden | 160/176.1 R |
| 5,103,889 | 4/1992 | Ford | 160/177 V |
| 5,379,825 | 1/1995 | Jelic | 160/168.1 R X |

*Primary Examiner*—David M. Purol

*Attorney, Agent, or Firm*—Anthony J. Casella; Gerald E. Hespos

[57] ABSTRACT

A safety tassel is provided for the lift cords of a Venetian blind assembly. The tassel includes a plurality of slots each of which can releasably receive a height adjustment cord of the Venetian blind assembly. Ends of the cords are knotted and fit in an open bottom of the recess. The tassel will remain affixed to the cord during normal use. However, lateral forces that would be encountered if a child is entangled between the cords will cause at least one cord to separate from the tassel.

12 Claims, 3 Drawing Sheets

SAFETY TASSEL FOR VENETIAN BLINDS

BACKGROUND OF THE INVENTION

1. Field of the Invention

The invention relates to a Venetian blind tassel that retains a plurality of height adjustment cords for a Venetian blind without creating the risk of strangulation to a small child that may play with the cord.

2. Description of the Prior Art

The prior art Venetian blind assembly includes a head rail in the form of a generally U-shaped channel that can be mounted horizontally near the top of a window. An elongate rod extends through the channel and is rotatable about its longitudinal axis. A plurality of pairs of flexible tapes extend through the channel. Ends of the tapes within the channel are secured to opposed longitudinal sides of the rod or to a disk mounted on the rod. Thus, rotation of the rod in a first direction will cause one tape in each pair to move upwardly and the other to move downwardly. Conversely, rotation of the rod in the opposed direction causes the respective tapes to move in opposite directions. Portions of the tapes below the head rail are secured to the bottom rail of the prior art Venetian blind assembly and are interconnected to one another by equally spaced flexible strips. The strips that connect the flexible tapes are used to support the long flat slats of the Venetian blind assembly. In this manner, the above described upward and downward movement of the respective flexible strips causes the Venetian blind slats to rotate in unison about their respective longitudinal axes.

A pair of slat tilting cords will extend downwardly from one end of the head rail and will have their upper ends operatively connected to the rod in the head rail. The lower ends of the cords are entirely separate and may have tassels connected thereto for decorative purposes and to avoid fraying of the cord ends. A downward force on one of these two cords will cause the rod in the head rail to rotate in a first direction, and will generate a corresponding tilting of the Venetian blind slats. A downward force on the other of these two cords will cause the rod in the head rail to rotate in the opposite direction, and will generate an opposite tilting of the Venetian blind slats. These cords that control the tilting of the blinds present virtually no safety problems and are not the subject of this invention.

Prior art Venetian blinds also include a plurality of height adjustment cords. One end of each height adjustment cord is securely affixed to the bottom rail of the Venetian blind assembly. The height adjustment cords extend up through or adjacent the slats and into the head rail. These cords then extend to one end of the head rail, and downwardly to a location that is conveniently accessible.

A downward pulling force exerted on the free ends of the height adjustment cords will raise the bottom rail of the prior art Venetian blind assembly, and will successively lift the Venetian blind slats. The prior art Venetian blind assembly typically includes a brake or rachet mechanism in the head rail to releasably hold the height adjustment cords in a selected position for maintaining the bottom rail of the blinds at a preferred height. Lateral movement of the free ends of the lifting cords will release the brake or rachet to permit gravitationally powered downward movement of the bottom rail and the Venetian blind slats.

Venetian blind assemblies for fairly narrow windows typically include two height adjustment cords connected near the respective ends of the bottom rail. Wider Venetian blind assemblies, however, may include four lifting cords connected to spaced apart locations on the bottom rail. As noted above, the slat tilting cords are functionally independent, and hence have their free ends entirely separate. The height adjustment cords, however, must work in unison to ensure that the slats remain substantially horizontal. As a result, the free ends of the height adjustment cord are connected to one another. These connections could be achieved by a simple knot. However, many prior art Venetian blinds have the free ends of the lifting cords connected to a tassel that resembles the tassels on the ends of the blind tilting cords.

The elevation of the free ends of the height adjustment cords varies inversely with the elevation of the bottom rail of the Venetian blind assembly. Thus, when the bottom rail of the Venetian blind assembly is near the window sill, the free ends of the height adjustment cords will be at their highest position. Conversely, when the bottom rail of the Venetian blind assembly is lifted to its highest point, the free ends of the height adjustment cords are very low. Most windows are at least four or five feet tall. Hence, the bottom rail of the Venetian blind assembly and the free ends of the height adjustment cords are likely to have a range of movement of at least four or five feet. As a result, the free ends of the height adjustment cords typically will be very close to the floor when the bottom rail of the Venetian blind assembly is at its highest point.

The interconnected free ends of the height adjustment cords create a potential safety hazard for small children, and particularly infants or toddlers. In this regard, a small child playing near the Venetian blinds may inadvertently or playfully insert his or her head through the loop defined by the interconnected free ends of the height adjustment cords. Strangulation and/or impeded blood flow to the brain can result, particularly if the small child falls while entangled with the height adjustment cords.

The prior art includes a safety tassel assembly for the height adjustment cords of Venetian blinds. The safety tassel assembly includes two separate tassels shaped like open-boxes. Each rectangular tassel includes a top wall with an aperture extending therethrough into the open interior of the box. The aperture in each tassel is dimensioned to receive a height adjustment cord of a blind. The top wall further includes a projection dimensioned to frictionally but releasably engage the other tassel. Each tassel further includes a bottom wall having a projection that can releasably engage the bottom wall of the other tassel. The height adjustment cords in a two-cord Venetian blind assembly are passed through the apertures in the top walls of the respective tassels of the tassel assembly, and are knotted. The tassels are then releasably engaged with one another by urging the projections on one tassel into frictional engagement with the projections on the other. The same tassel assembly can be used for a four-cord Venetian blind by shaping the top wall of each tassel to grip the third and fourth cords between the respective top walls of the assembly. This prior art tassel assembly is effective for preventing strangulation. However, this prior art tassel assembly presents several additional inefficiencies. First, the opposed halves of the tassel assembly are easily separated from one another during normal use of the blinds. Thus, the cords may be pulled different amounts resulting in an uneven lifting of the blinds. Second, the top wall of each tassel is small and thin and is weakened by the aperture formed therein. This top wall can break in response to forces generated during normal use of the Venetian blind, thereby causing the small plastic part to fall on the floor. This small part is of a size that can readily be ingested by a small child, and thus creates a different type of potential safety problem. Additionally, the prior art height adjustment cord safety tassel assembly requires two separate molds, thereby doubling the mold manufacturing cost and reducing the mold operational efficiency. Furthermore, the cord receiving aperture in the top wall requires a cam action mold with fairly expensive tooling and complicated molding.

In view of the above, it is an object of the subject invention to provide an improved safety tassel for the height adjustment cords of a Venetian blind assembly.

It is another object of the subject invention to provide a one piece height adjustment cord tassel to ensure level lifting of the Venetian blinds and to provide more efficient manufacturing and inventory control.

Another object of the subject invention is to provide a height adjustment cord tassel that is not subject to breakage during normal use.

SUMMARY OF THE INVENTION

The subject invention is directed to a tassel for the height adjustment cords of a Venetian blind assembly. The tassel includes a central support wall having a plurality of grooves dimensioned for releasably engaging a height adjustment cord of a Venetian blind assembly. The tassel further includes a plurality of side walls projecting from the central support wall and defining an open-bottomed recess on the tassel. The side walls are spaced apart to define slots aligned with the grooves in the central support wall of the tassel. The slots between the side walls also are dimensioned to releasably receive a height adjustment cord therein. However, the side walls may be chamfered at the bottom to define an easy entry for at least certain slots. One pair of adjacent side walls may be interconnected to one another by a safety wall near the open-bottomed recess. Thus, the slot between these respective side walls extends only partly toward the open-bottomed recess of the tassel.

The tassel may be used by passing the height adjustment cords into the slots between adjacent side walls, and tying knots on portions the cords in the open-bottomed recess of the tassel. The cords are pulled sufficiently for the knots to engage against the central support wall of the tassel and for portions of each height adjustment cord adjacent the knot to engage in the grooves of the central support wall.

The tassel and height adjustment cord assembly is used in the conventional manner by merely exerting a downward pulling force on the tassel and/or portions of the cords adjacent thereto. Forces on the tassel will cause the central support wall of the tassel to engage the knots of the height adjustment cords, and hence will pull the cords downwardly while simultaneously lifting the bottom rail of the Venetian blind assembly upwardly. If a child inserts his or her head between adjacent height adjustment cords, forces exerted by the child's head on the cords will have a lateral component. These laterally directed forces on the cord relative to the tassel will cause the cord to initially slide laterally out of the groove of the central support wall. This will cause the tassel to pivot, and further forces will urge the height adjustment cord through the associated slot between the side walls and out through the open recess. Thus, at least one height adjustment cord will separate from the tassel to define two unconnected height adjustment cords and no loop that could potentially injure a child.

Embodiments of the invention having the safety wall between two adjacent side walls ensure that the associated cord remains attached to the tassel. Thus, the tassel will not fall from the cord, and the ingestible plastic part will not lie unattached on the floor and accessible to a baby or toddler.

A height adjustment cord that has become separated from the tassel can be reinserted easily into the tassel by merely holding the knot into the open-bottomed recess of the tassel, and advancing the cord into the opened bottom end of the slot. Unlike the above described prior art safety tassel, the top central support wall can have sufficient height dimension to avoid breakage in response to downward forces. Additionally, the unique construction of the tassel ensures that each of the plurality of cords will remain releasably engaged in the tassel during all normal usage. Thus, uneven lifting of the Venetian blind is extremely unlikely.

DETAILED DESCRIPTION OF THE PREFERRED EMBODIMENT

Figure 1:
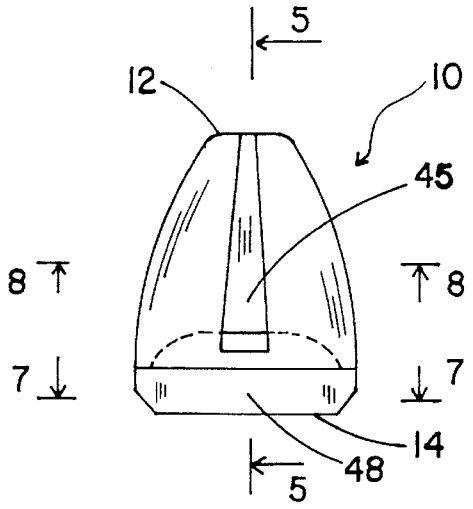
FIG. 1 is a front elevational view of a safety tassel in accordance with the subject invention.
Figure 2:
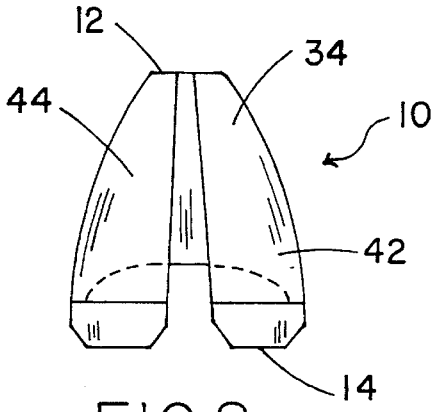
FIG. 2 is a side elevational view of the safety tassel.
Figure 3:
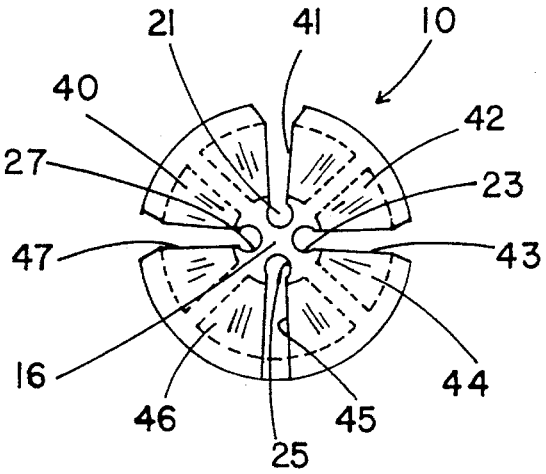
FIG. 3 is a top plan view of the safety tassel.
Figure 4:
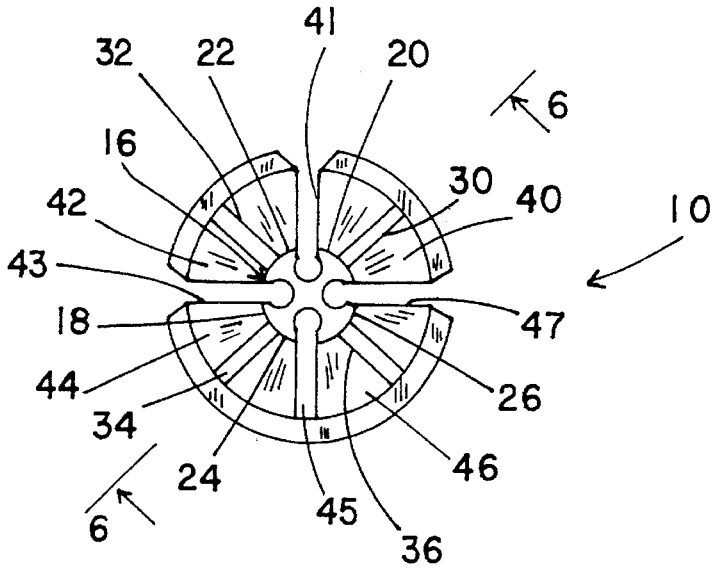
FIG. 4 is a bottom plan view of the safety tassel.
Figure 5:
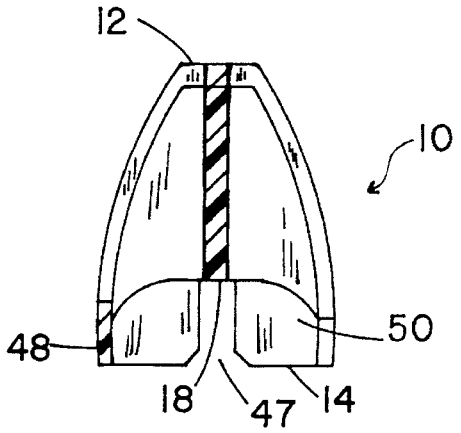
FIG. 5 is a cross-sectional view taken along line 5—5 in FIG. 1.
Figure 6:
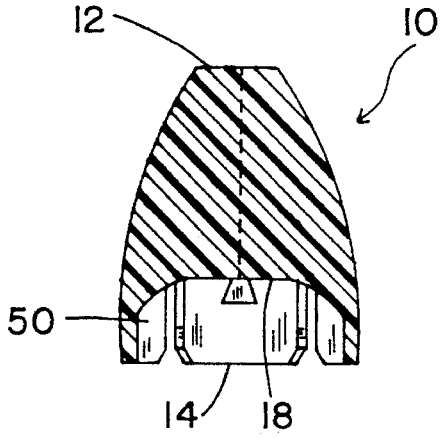
FIG. 6 is a cross-sectional view taken along line 6—6 in FIG. 4.
Figure 7:
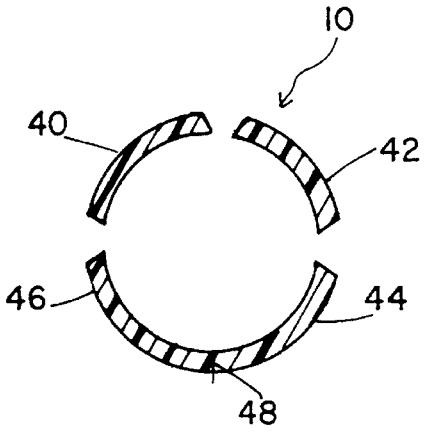
FIG. 7 is a cross-sectional view taken along line 7—7 in FIG. 1.
Figure 8:
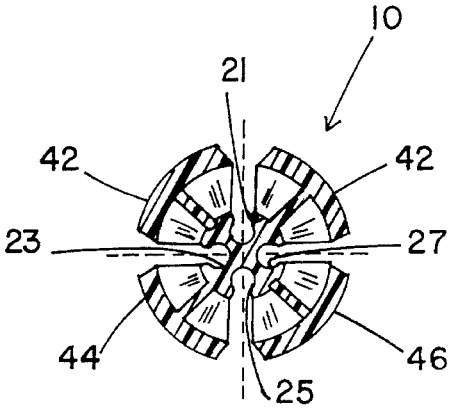
FIG. 8 is a cross-sectional view taken along line 8—8 in FIG. 1.

A safety tassel in accordance with the subject invention is identified generally by the numeral 10 in FIGS. 1–9. The tassel 10 is unitarily molded from a plastic material to define a generally parboloid shape with a narrowly tape:red top end 12 and a wide bottom end 14. As shown most clearly in FIGS. 3–5, the tassel 10 includes a generally cylindrical core wall 16 having a top end defined by the top 12 of the tassel 10 and a bottom end 18 disposed at a location intermediate the opposed top and bottom ends 12 and 14 of the tassel 10. The generally cylindrical central core wall 16 is defined by wall sectors 20, 22, 24 and 26 which are formed to define four radially opening, axially aligned grooves 21, 23, 25 and 27 which are separated from one another by approximately 90°. Each groove 21, 23, 25 and 27 defines a width for releasably engaging a height adjustment cord. Additionally, each groove 21, 23, 25 and 27 is tapered to define a greater width near the bottom end to facilitate insertion and removal of the height adjustment cord as explained herein.

The safety tassel 10 further includes four radially extending support walls 30, 32, 34 and 36 which project outwardly from the respective wall sectors 20, 22, 24 and 26 of the cylindrical core wall 16. Radially outer extremes of each support wall 30–36 are arcuately configured to conform to the parboloid shape of the safety tassel 10. Thus, each support wall defines a radially smaller dimension nearer the top end 12 of the tassel, and a correspondingly greater radial dimension at locations closer to the bottom 14 of the tassel 10. The bottom ends of the support walls 30–36 are generally concavely configured as shown most clearly in FIGS. 5 and 6.

The tassel 10 further includes parbolically generated side walls 40, 42, 44 and 46 symmetrically disposed on the radially outer extremes of the support walls 30, 32, 34 and 36 respectively. The side walls 40 and 42 are separated from one another along their entire respective lengths by a slot 41. Similarly, the side wall 42 is separated from the side wall 44 along their entire respective lengths by slot 43, and the side wall 46 is separated from the side wall 40 along their entire respective lengths by a slot 47. Each slot 41, 43 and 47 is dimensioned to slidably receive a height adjustment cord. However, the bottom end of each slot 41, 43 and 47 is chamfered to define a wide opening that facilitates insertion of a cord. Additionally, each slot 41, 43 and 47 is tapered to define a greater width near the bottom of the tassel to facilitate both insertion and removal of the height adjustment cord from the tassel. The side wall 44 is separated from the side wall 46 by a slot 45 which extends from the top 12 of the safety tassel 10 to a location between the bottom end 18 of central core wall 16 and the bottom end 14 of the tassel 10. However, a safety wall 48 extends unitarily between the side walls 44 and 46 adjacent the bottom end 14 of the tassel 10. With this construction, as shown most clearly in FIGS. 4, 5 and 6, tassel 10 includes a knot receiving recess 50 opening into the bottom end 14 of the tassel 10. The chamfered bottom end of slots 41, 43 and 47 provide convenient and easy access into the knot receiving recess 50. Additionally, the bottom extreme of the slot 45 provides access to the knot receiving recess by an unknotted end of the height adjustment cord.

Figure 9:
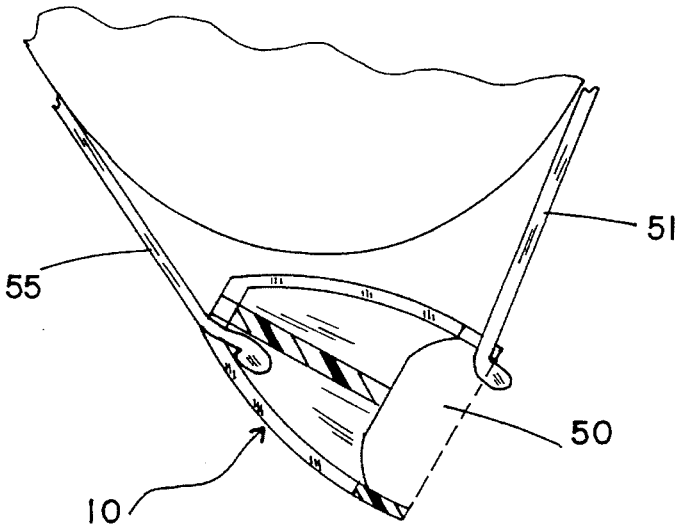
FIG. 9 is a cross-sectional view similar to FIG. 5, but showing a cord being separated from the tassel in response to differential lateral forces exerted thereon.

The safety tassel 10 may be used with two or four height adjustment cords of a Venetian blind assembly. As shown in FIG. 9, an unknotted end of one height adjustment cord 55 may be passed through the bottom end of slot 45 and into the knot receiving recess 50. The cord 55 may then be knotted for retention in recess 50, and portions of the cord 55 spaced from the knot may be slid into the groove 25 of the central core wall 16. A second height adjustment cord 51 may be knotted, and the knot may be positioned in the recess 50. Portions of the cord 51 adjacent the knot may be slipped through the slot 41 and into the groove 21 of the central core wall 16.

Downward pulling forces exerted on the tassel 10 will be transmitted to the cords 51 and 55, and may be used to selectively raise and lower the Venetian blinds. However, as shown in FIG. 9, oppositely directed lateral forces will be exerted upon the cords 51 and 55 if a child inadvertently or playfully becomes entangled between the cords 51 and 55. These differential forces will cause the cord 51 to pull out of the groove 21 and to slip through the slot 41 to completely separate the height adjustment cord 51 from the safety tassel 10. The tassel 10, however, will remain affixed to the cord 55 to ensure that the small ingestible tassel 10 does not lie unattached at a location where it can be accessed by a toddler or baby. The cord 60 readily can be reattached to the tassel 10 in the manner described above.

While the invention has been described with respect to a preferred embodiment, it is apparent that various changes can be made without departing from the scope of the invention as defined by the appended claims. For example, the tassel can be made in other shapes and can be provided with fewer than the four slots and four grooves illustrated herein.

I claim:

1. A safety tassel for height adjustment cords of a Venetian blind assembly, each said height adjustment cord having a knot formed at one end, each said knot defining a cross-sectional dimension greater than cross-sectional dimensions of the respective cord at locations spaced from the knot, said safety tassel comprising a central support wall having opposed top and bottom ends, a plurality of side walls connected to and extending from said central support wall, said side walls projecting below said central support wall to define a recess for receiving a plurality of said knots, said side walls being spaced from one another to define a plurality of cord receiving slots therebetween, each said slot being dimensioned to slidably receive at least one said cord therein and to prevent passage of the knots therethrough, whereby downward forces on said tassel will pull said cords, and whereby laterally directed forces on at least one said cord will cause at least one said cord to slide through the associated slot and separate from said tassel.

2. The tassel of claim 1, wherein said tassel is unitarily molded from a thermoplastic material.

3. The tassel of claim 1, comprising two said side walls and two said slots therebetween.

4. The tassel of claim 1, comprising four said side walls and four said slots therebetween.

5. The tassel of claim 4, wherein two of said side walls are joined by a safety wall adjacent the bottom end of the tassel, portions of the slot adjacent said safety wall providing communication to said knot receiving recess in the bottom of the tassel, said safety wall preventing the height cord in the associated slot from separating from the tassel.

6. The tassel of claim 1, wherein said central support wall comprises a generally cylindrical core wall having a plurality of cord receiving grooves formed therein, a plurality of radially aligned support walls projecting outwardly from said cylindrical core wall at locations intermediate the respective grooves, said support walls being connected to and supporting the respective side walls of the tassel.

7. The tassel of claim 1, wherein the side walls are substantially tapered, such that said tassel has a narrow top end and a wide bottom end, said tapered side walls facilitating separation of at least one said cord from said tassel in response to laterally directed forces on one said cord.

8. The tassel of claim 1, wherein at least one said slot includes a chamfered entry adjacent the bottom end of the tassel for facilitating entry of the cord into the respective slot.

9. The tassel of claim 1, wherein at least one said slot is tapered continuously from top to bottom to define wider widths at locations closer to the bottom of the tassel for facilitating separation of said height adjustment cord from said tassel.

10. A Venetian blind assembly having a plurality of height adjustment cords suspended therefrom, each said height adjustment cord having a knot formed at one end, each said knot defining a cross-sectional dimension greater than cross-sectional dimensions of each respective cord at locations spaced from the knot, said assembly further comprising a safety tassel unitarily molded from a plastic material and having a central support wall with opposed top and bottom ends, a plurality of side walls connected to and extending from said central support wall, said side walls being spaced from one another to define a plurality of cord receiving slots therebetween, each said slot being tapered to define greater widths near the bottom of the tassel and being dimensioned to releasably receive one said cord therein and to prevent passage of the respective knot therethrough, whereby downward forces on said tassel will pull said cords, and whereby laterally directed forces on at least one said cord will cause at least one said cord to slide through the associated slot and separate from said tassel.

11. The Venetian blind assembly of claim 10, wherein two of said side walls are joined by a safety wall adjacent the bottom end of the tassel, portions of the slot adjacent said safety wall providing communication to said knot receiving recess in the bottom of the tassel, said safety wall preventing the height cord in the associated slot from separating from the tassel.

12. The Venetian blind assembly of claim 10, wherein the side walls are substantially tapered, such that said tassel has a narrow top end and a wide bottom end, said tapered side walls facilitating separation of at least one said cord from said tassel in response to laterally directed forces on one said cord.

* * * * *